United States Patent [19]

Kushima et al.

[11] 4,116,557

[45] Sep. 26, 1978

[54] ELECTROPHOTOGRAPHIC COPYING APPARATUS

[75] Inventors: Teizo Kushima, Osaka; Takaji Kurita, Kawachinagano; Hiroaki Mizunoe, Sakai, all of Japan

[73] Assignee: Minolta Camera Kabushiki Kaisha, Osaka, Japan

[21] Appl. No.: 753,088

[22] Filed: Dec. 21, 1976

[30] Foreign Application Priority Data

Dec. 27, 1975 [JP] Japan ..... 51/156506

[51] Int. Cl.[2] ..... G03G 15/28

[52] U.S. Cl. ..... 355/8; 355/1; 355/3 TR

[58] Field of Search ..... 355/3 R, 3 TR, 3 DR, 355/8, 11, 66, 67, 1

[56] References Cited

U.S. PATENT DOCUMENTS

| | | | |
|---|---|---|---|
| 3,637,303 | 1/1972 | Komori et al. | 355/66 X |
| 3,850,520 | 11/1974 | Washio et al. | 355/66 X |
| 3,869,202 | 3/1975 | Tabata et al. | 355/3 R |
| 3,955,888 | 5/1976 | Kakiucki et al. | 355/8 X |
| 3,970,383 | 7/1976 | Honda et al. | 355/8 X |

*Primary Examiner*—Fred L. Braun

[57] ABSTRACT

An electrophotographic copying apparatus of the slit exposure type which includes a scanning box having image forming elements such as a photoreceptor drum, a corona charger, an optical system, and a transfer member, etc. incorporated therein. The photoreceptor drum is rotated in synchronization with the movement of the scanning box, while copy paper is transported by the direction of movement of the scanning box at a speed equivalent to the sum of the moving speed of the scanning box and the circumferential speed of the photoreceptor drum for causing the copy paper to contact the photoreceptor surface in synchronization with each other so that the image of an original formed on the photoreceptor surface is transferred onto the copy paper. The optical system includes an illuminating device which directs light rays toward the original being copied and also at a position on the photoreceptor surface following image transfer for erasing the residual charges remaining on the photoreceptor surface.

12 Claims, 10 Drawing Figures

ELECTROPHOTOGRAPHIC COPYING APPARATUS

Figure 1:
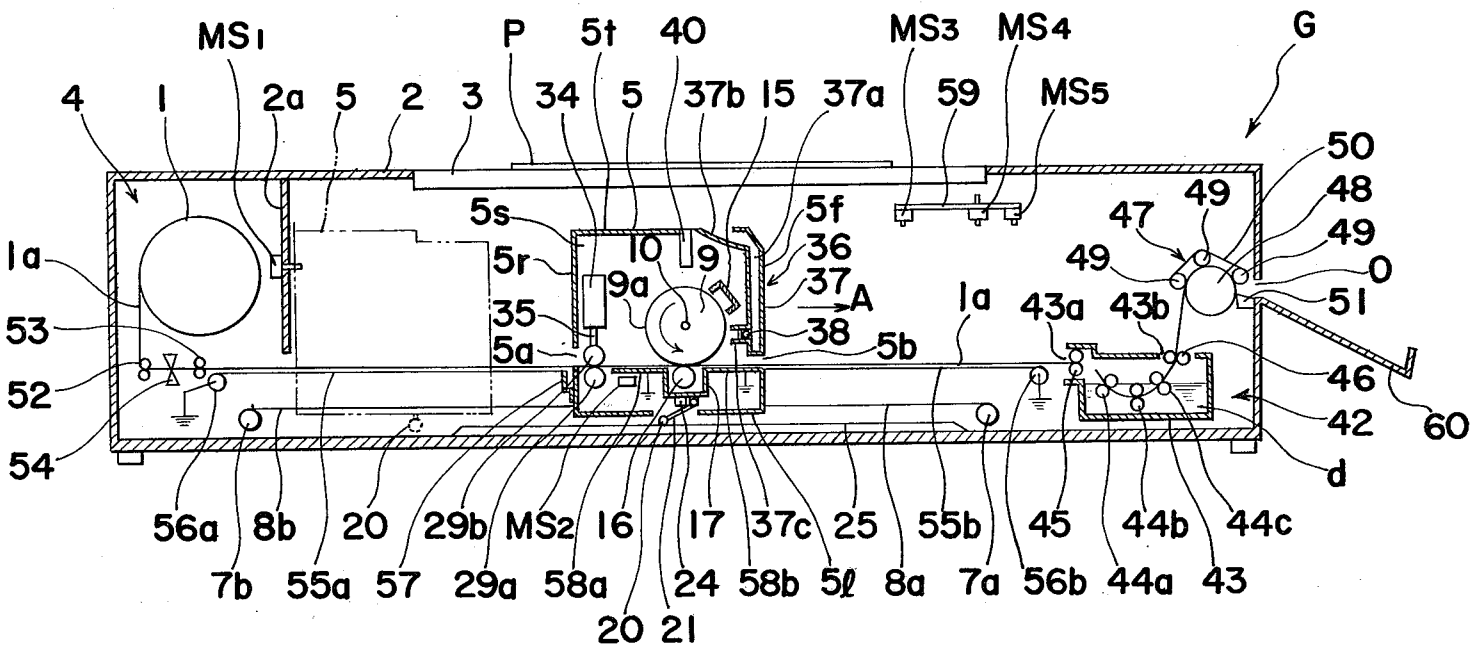

The present invention relates to an electrophotographic copying apparatus and more particularly to an electrophotographic copying apparatus of the electrostatic latent image or toner powder image transfer type.

Conventionally, in the electrophotographic copying apparatuses of the kind having a slit exposure system which are generally characterized by their small sizes, there have widely been employed two types, i.e., a movable platform type wherein a platform to hold an original to be copied thereon is adapted to move, and a movable optical system type wherein an optical system is movable for exposing a preliminarily charged photoreceptor surface to light images of the original. In both of the above described types, however, there are disadvantages, such as that since the platform or the optical system is inevitably disposed at the upper portion of the housing of the copying apparatus for reciprocal movement thereat, not only must the strength of the means for moving the platform or optical system be considerably reinforced, but driving thereof in sychronization with the circumferential speed of the photoreceptor, for example, in the configuration of a drum requires extremely high mechanical accuracy which is difficult to achieve in rapid movement.

Particularly, in the movable platform type, since times when heavy documents such as books and the like are placed on the platform should be taken into account and moreover, members for holding such books, with pages thereof opened, must be provided for copying, the platform itself and the moving means therefor are required to be particularly strong, while the moving speeds of the platform tend to vary, depending on the loads or the weights of such documents, with consequent disagreement between the cycles of rotation of the photoreceptor drum and the transportation of copy paper. Furthermore, since the platform extends beyond one side of the copying apparatus housing during its reciprocal movement, extra space corresponding to such an extension is unavoidably required, thus affecting adversely the amount of space to be occupied by the copying apparatus.

Accordingly, an essential object of the present invention is to provide a transfer type electrophotographic copying apparatus of the slit exposure system which functions accurately and is compact in size, with substantial elimination of the disadvantages inherent in the conventional electrophotographic copying apparatuses of this kind.

Another important object of the present invention is to provide an electrophotographic copying apparatus of the above described type which is sufficiently rigid in construction so as to be capable of processing heavy documents as well as light documents without any difficulty.

A further object of the present invention is to provide an electrophotographic copying apparatus of the above described type which has a simple structure and can be manufactured at low cost.

According to a preferred embodiment of the present invention, the electrophotographic copying apparatus of slit exposure type includes a scanning box in which there are incorporated image forming elements such as a rotatable photoreceptor drum having a known photoreceptor surface on the outer periphery thereof, a corona charger for preliminarily charging the photoreceptor surface, an optical system for exposing the preliminarily charged photoreceptor surface to light images of an original to be copied for the formation of an electrostatic latent image of the original on said photoreceptor surface and transfer means for transferring the thus formed latent image onto transfer material or copy paper, and which is movably disposed in a lower portion of the housing of the copying apparatus for reciprocal movement at a constant speed, with the photoreceptor drum being adapted to rotate in association with the movement of the scanning box, while the copy paper is transported from a copy paper feeding section in the direction of movement of the scanning box at a speed equivalent to the sum of the moving speed of the scanning box and the circumferential speed of rotation of the photoreceptor drum for causing the copy paper to contact the photoreceptor surface in synchronization therewith so that the image of the original preliminarily formed on the photoreceptor surface as the latent image or visible toner powder image in the known manner is transferred onto the copy paper, by which arrangement, a compact electrophotographic copying apparatus which functions accurately is advantageously provided and which has a simple construction and sufficient rigidity to support loads.

Figure 2:
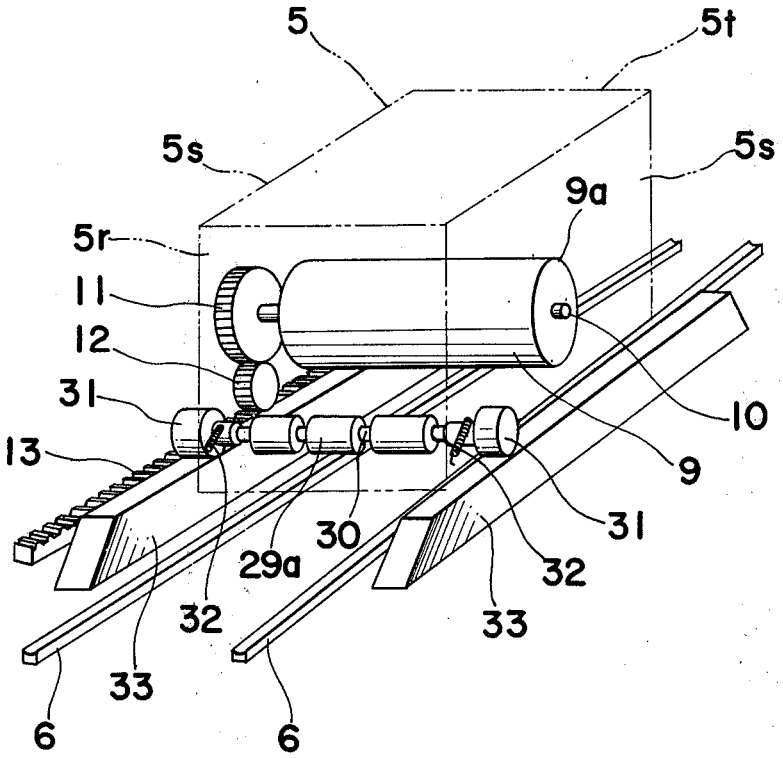
Figure 3:
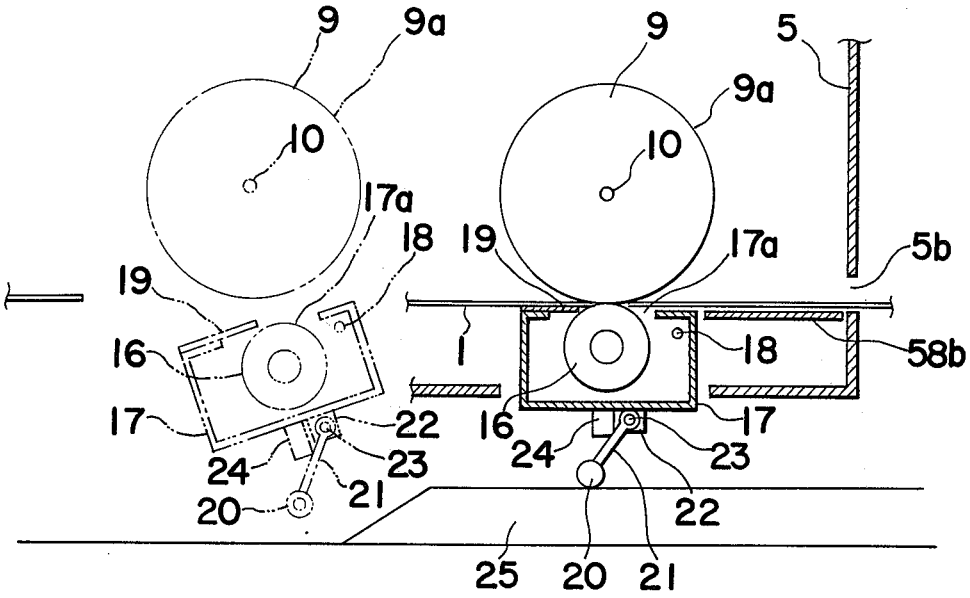
Figure 4:
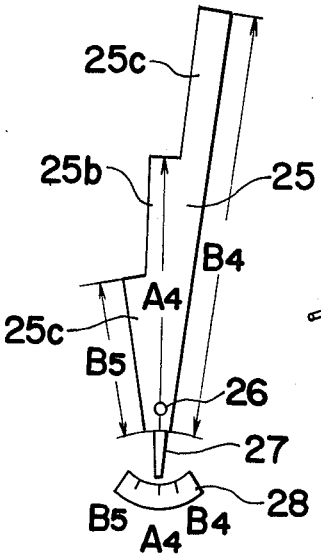
Figure 5:
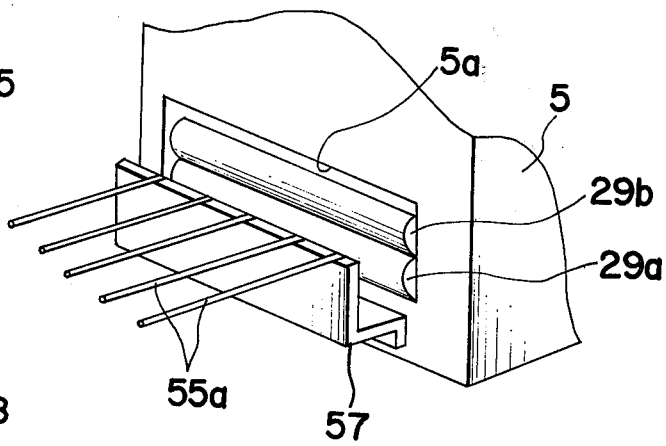
Figure 6:
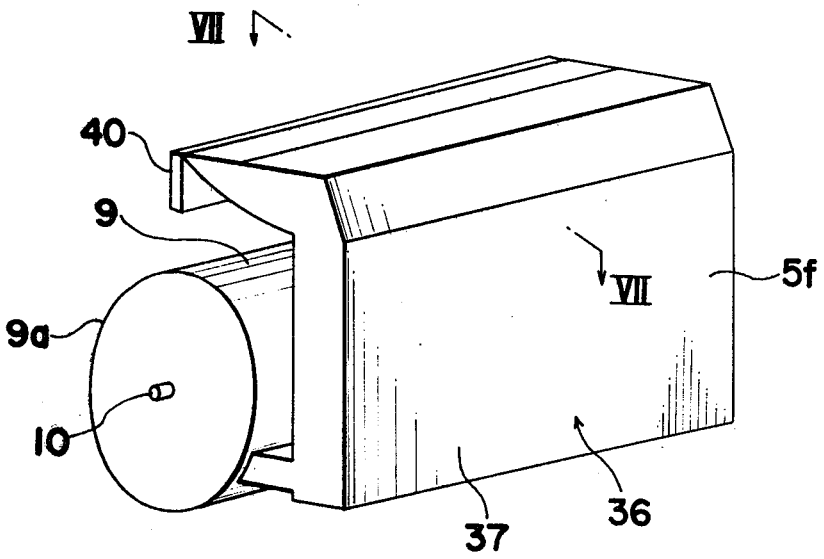
Figure 7:
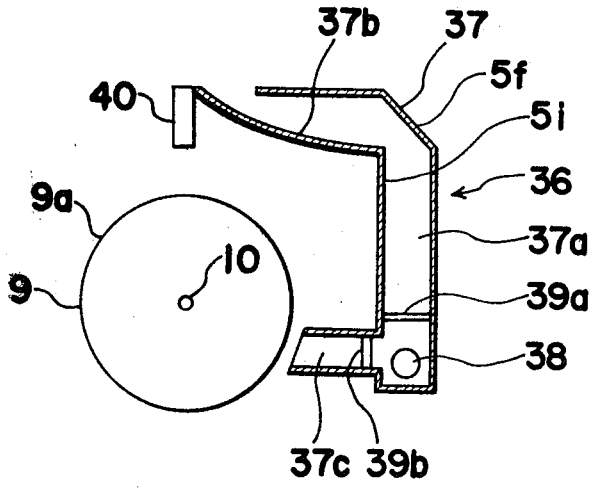
Figure 8:
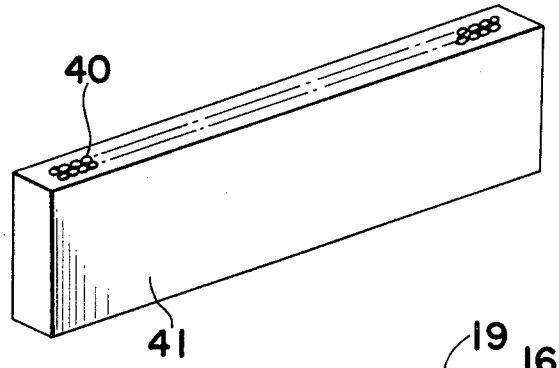

These and other objects and features of the present invention will become apparent from the following description taken in conjunction with the preferred embodiment thereof with reference to the attached drawings in which:

FIG. 1 is a schematic diagram showing a sectional side view of an electrophotographic copying apparatus according to one embodiment of the present invention, FIG. 2 is a perspective view showing, on an enlarged scale, a photoreceptor drum driving mechanism employed in the copying apparatus of FIG. 1, FIG. 3 is a schematic diagram showing, on an enlarged scale, a sectional side view of a transfer frame and its associated mechanism employed in the copying apparatus of FIG. 1, FIG. 4 is a top plan view of a guide rail employed for the transfer roller of FIG. 3, FIG. 5 is a fragmentary perspective view showing an arrangement for copy paper transportation employed in the copying apparatus of FIG. 1, FIG. 6 is a perspective view showing, on an enlarged scale, an arrangement of an illuminating device with respect to the photoreceptor drum employed in the copying apparatus of FIG. 1, FIG. 7 is a cross sectional view taken along the line VII—VII of FIG. 6, FIG. 8 is a perspective view showing, on an enlarged scale, an image transmitter formed by a bundle of optical fibers having graded refractive indexes employed in the copying apparatus of FIG. 1.

Figure 9:
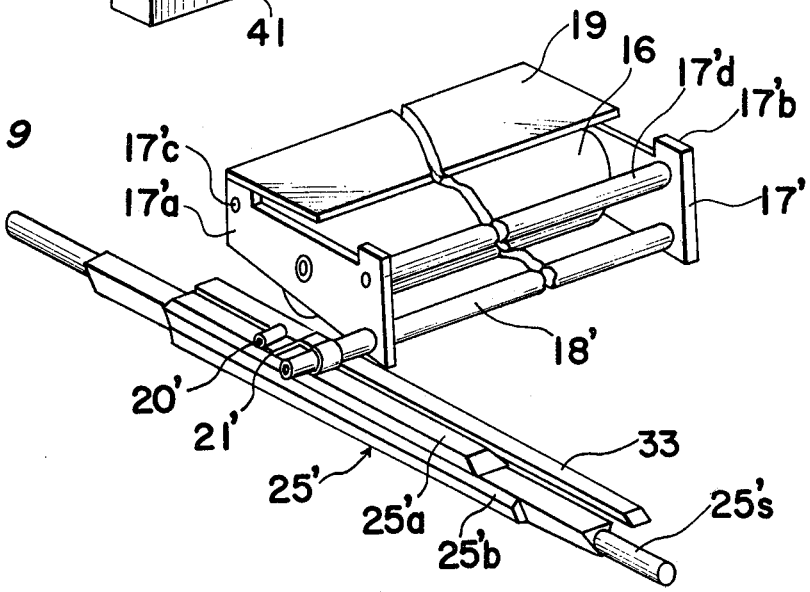
Figure 10:
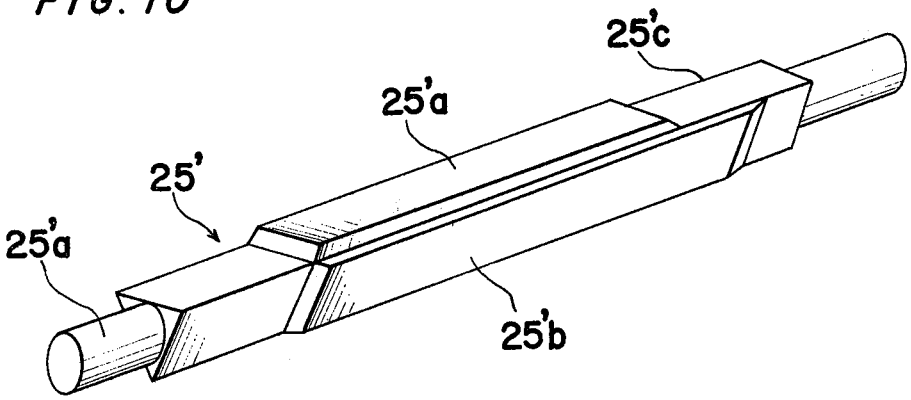

FIG. 9 is a perspective view showing a modification of the transfer frame and its associated mechanism of FIG. 3, and FIG. 10 is a perspective view showing, on an enlarged scale, a guide rail employed in the modification of FIG. 9.

Before the description of the present invention proceeds, it is to be noted that like parts are designated by like reference numerals throughout several views of the accompanying drawings.

Referring now to FIGS. 1 through 8, there is shown in FIG. 1 a latent image transfer type electrophotographic copying apparatus G having a stationary platform according to one embodiment of the present invention. The copying apparatus G which employs copy paper 1*a* fed from a roll 1 disposed in a copy paper feeding section 4 at the left-hand side of an apparatus housing 2 generally includes a transparent platform 3, for example, of glass to support an original P to be copied thereon, which platform 3 is fixedly disposed at the top portion of the apparatus housing 2, and a scanning box or frame 5 of cubic box-like configuration in which there are incorporated image forming elements such as a photoreceptor drum 9 having a known photoreceptor layer or surface 9*a* formed on the outer periphery thereof and rotatably disposed approximately in the central portion of the scanning box 5, a corona charger 15 disposed adjacent to the photoreceptor surface 9*a* for preliminarily charging the photoreceptor surface 9*a*, an illuminating device 36 equipped with a light source or lamp 38 for illuminating the original P placed on the platform 3, known image transmitting glass fibers 40 of light converging nature disposed as an optical system at the top portion of the scanning box 5 for transmitting the light images of the original P onto the preliminarily charged photoreceptor surface 9*a* to form an electrostatic latent image of the original P on the photoreceptor surface 9*a*, and a transfer roller 16 disposed below the photoreceptor drum 9 for transferring the latent image formed on the photoreceptor surface 9*a* onto a copy paper 1*a* fed from the roll 1. The copying apparatus G further includes a developing device 42 of the wet type for developing the latent image transferred onto the copy paper 1*a* into a visible toner image and a fixing device 47 for fixing the visible toner image onto the same copy paper 1*a* in a known manner, both of which devices 42 and 47 are sequentially disposed at the right hand portion of the apparatus housing 2 in FIG. 1.

Referring particularly to FIG. 2, the scanning box 5 having a top wall 5*t*, side walls 5*s*, front and rear walls 5*f* and 5*r*, and a bottom wall 5*l* is reciprocatingly and movably mounted on a pair of spaced guide rails 6 secured to frames (not shown) in the apparatus housing 2 through rollers (not shown) rotatably provided, for example, at the lower portions of the side walls 5*s* of the scanning box 5, while ends of wires 8*a* and 8*b* (FIG. 1) which are wound on corresponding winding drums or rollers 7*a* and 7*b* at the other ends thereof are secured to the front and rear walls 5*f* and 5*r* of the scanning box 5 respectively. The winding drum 7*a* rotatably supported by frames (not shown) of the apparatus housing 2 is coupled to a driving means (not shown) through clutch means (not shown) for clockwise rotation thereof, while the winding drum 7*b* also rotatably supported by the frames of the apparatus housing 2 has wire spring means (not shown) wound around its shaft (not shown), so that, when the clutch means is engaged for rotating the drum 7*a* clockwise so as to wind the wire 8*a* onto the drum 7*a*, the scanning box 5 runs along the guide rails 6 in the direction shown by an arrow A. In this case, the winding drum 7*b* rotates clockwise for paying out the wire 8*b* as the scanning box 5 advances, while the wire spring means is wound onto the shaft of the drum 7*b* for storing counterclockwise urging force. Upon disengagement of the clutch means after completion of copying operation in a manner described in detail hereinbelow, with the scanning box 5 moved in the direction of the arrow A, the winding drum 7*a* is released from the driving force from the driving means, and the winding drum 7*b* is rotated counterclockwise by the urging force stored in the wire spring means on the shaft of the drum 7*b* in the above described manner for causing the scanning box 5 to return in a direction opposite to that shown by the arrow A.

It should be noted here that the arrangement of the winding drum 7*b* and the spring means described as employed in the above embodiment may be replaced by a single compression spring means connected at one end thereof to the corresponding end of the wire 8*b* and at the other end thereof to a frame (not shown) of the copying apparatus provided that such compression spring means has sufficient force to cause the scanning box 5 to return to the stand-by position upon termination of the scanning.

The photoreceptor drum 9 having a relatively small diameter is fixedly mounted on a shaft 10 rotatably supported by side walls 5*s* of the scanning box 5 and disposed in a direction normal to the advancing direction A of the scanning box 5, while a gear 11 secured adjacent to one end of the shaft 10 engages an idle gear 12 rotatably mounted on the side wall 5*s* of the scanning box 5, with the idle gear 12 meshing with a rack 13 disposed on a bottom portion of the apparatus housing 2 in a direction parallel to the advancing direction A of the scanning box 5. Accordingly, during advancement of the scanning box 5 in the direction of the arrow A, the photoreceptor drum 9 rotates counterclockwise about the shaft 10 at a constant circumferential speed, while the same photoreceptor drum 9 rotates clockwise during returning movement of the scanning box 5.

Referring also to FIGS. 3 and 4, the transfer roller 16 extending across the width of the photoreceptor drum 9 is rotatably supported in a supporting member or frame 17 by side walls of the frame 17, with one portion of the outer periphery of the roller 16 being exposed through an opening 17*a* formed in the upper portion of the frame 17. The frame 17 which is pivotally mounted by a shaft 18, at the upper right corner of its side wall, on the corresponding side wall 5*s* of the scanning box 5 in a position below the photoreceptor drum 9 and adjacent to the bottom 5*l* of the scanning box 5 is provided with a transfer stabilizing plate 19 fixed along one side edge of the opening 17*a*, and an arm 21 having a roller 20 rotatably mounted at one end thereof and pivotally connected at its other end to the bottom wall of the frame 17 by a pin 23 and a bracket 22 secured to said bottom wall, with a stop member 24 also being fixed to the bottom wall of the frame 17 in a position adjacent to the arm 21. Meanwhile, a guide rail 25 of trapezoidal configuration for engagement with the arm 21 is disposed at the bottom portion of the apparatus housing 2 in a direction parallel to the advancing direction A of the scanning box 5, and when the scanning box 5 is at a stand-by position shown by chain lines in FIG. 1, the frame 17 is turned counterclockwise about the shaft 18 by its own weight, with the transfer roller 16 being spaced from the photoreceptor surface 9*a*, while, when the roller 20 rides on the guide rail 25 as the scanning box 5 advances in the direction of the arrow A, the arm 21 is rotated clockwise about the shaft 23 and consequently, rotates the frame 17 clockwise as a whole about the shaft 18 for causing the transfer roller 16 to contact the photoreceptor surface 9*a* under pressure through the copy paper 1*a*. Furthermore, the guide rail 25 has, for example, guide portions 25*a*, 25*b* and 25*c* (FIG. 4) corresponding to lengths of copy paper sizes, for example, B5 (182 × 257 mm), A4 (210 × 297 mm) and B4 (257 × 364 mm), with respect to the advancing direction A of the scanning box 5, and is pivotally connected at one end thereof to the bottom of the apparatus housing 2 by a shaft 26, while a pointer 27 is fixed at an extreme end of said one end of the guide rail 25 for setting the pointer 27 to graduations of required copy size on a scale plate 28 disposed adjacent said pointer 27, so that the length of time the transfer roller 16 contacts the photoreceptor surface 9*a* through the copy paper 1*a* is adjusted by proper setting of the pointer 27 which is associated in its movement with an operating member 59 mentioned later.

Referring also to FIG. 5, a pair of juxtaposed copy paper feeding rollers 29*a* and 29*b* rotatably disposed within the scanning box 5 adjacent to an rectangular opening 5*a* which is formed in the rear wall 5*r* of the scanning box 5 are adapted to move vertically, with the lower roller 29*a* thereof being normally urged downward by coil springs 32 (FIG. 2) directed over the roller 29*a* in positions adjacent to opposite ends thereof and connected to the bottom wall 5*l* of the scanning box 5, while the same roller 29*a* is raised to an upper position ready for copy paper transportation when a pair of rollers 31 which are rotatably mounted at opposite ends of a shaft 30 for the roller 29*a* ride over a corresponding pair of spaced guide rails 33 of trapezoidal configuration secured to the bottom of the apparatus housing 2 in a direction parallel to the advancing direction A of the scanning box 5 as is most clearly shown in FIG. 2. On the other hand, the upper roller 29*b* (FIG. 1) is rotatably supported at one end of a plunger 35 of a solenoid 34 disposed above the lower roller 29*a*, and when the scanning box 5 is located at the stand-by position shown by the chain lines in FIG. 1 in contact with a microswitch MS1 mounted on a partition wall 2*a* of the apparatus housing 2 for turning on the microswitch MS1, the solenoid 34 is energized to retract the plunger 35 and consequently to raise the roller 29*b* upwardly, while when the leading edge of the copy paper 1*a* fed into the scanning box 5 in a manner as described hereinbelow contacts a microswitch MS2 disposed in the scanning box 5 adjacent to the rollers 29*a* and 29*b* to turn on the microswitch MS2, the solenoid 34 is deenergized, with consequent descent of the roller 29*b* to hold the copy paper 1*a* between the rollers 29*a* and 29*b* in preparation for copy paper transportation after initiation of the copying operation.

Referring also to FIGS. 6 and 7, the illuminating device 36 includes a casing 37 defined by the front wall 5*f* of the scanning box 5 and an inner wall 5*i* spaced from each other and having reflecting inner surfaces, and light source means, for example, a lamp 38 disposed at the bottom portion of the casing 37. Above the lamp 38, the casing 37 is provided with a light conducting portion 37*a* having a quadratic curve-like surface portion 37*b* for conducting light rays from the lamp 38 towards the platform 3, while, at one side of the lamp 3, the casing 37 extends laterally toward the photoreceptor drum 9 to form another light conducting portion 37*c* for directing the light rays from the same lamp 38 onto the photoreceptor surface 9*a* immediately before the corona charger 15. A color correction filter 39*a* and a heat prevention filter 39*b* are disposed in the light conducting portions 37*a* and 37*c* in positions adjacent to the lamp 3, if necessary. In the upper portion of the scanning box 5 immediately above the photoreceptor drum 9 in a position where the upper edge of the quadratic curve-like surface portion 37*b* is close to the corresponding edge of the top wall 5*t* of the scanning box 5, the image transmitter 40 formed by a bundle of optical fibers having graded refractive indexes is disposed for transmitting the light images of the original P reflected through the platform 3 onto the photoreceptor surface 9. As shown in FIG. 8, the image transmitter 40 includes a casing 41 of rectangular box-like configuration in which a plurality of single image transmitter elements having graded refractive indexes are arranged to extend across the width of the photoreceptor drum 9. The image transmitter as described above is disclosed, for example, in U.S. Pat. No. 3,658,407 patented on Apr. 25, 1972, so that reference may be made thereto for the details thereof.

Needless to say the image transmitter described as employed for the optical system in the above embodiment may be replaced by a conventional mirror and lens assembly if desired.

Referring back to FIG. 1, the developing device 42 of the wet type includes a developing tank 43 containing therein developing solution *d*, three pairs of juxtaposed developing rollers 44*a*, 44*b* and 44*c* rotatably disposed in the tank 43 and mostly immersed in the solution *d*, a pair of transportation rollers 45 rotatably disposed at the inlet side 43*a* of the tank 43, and another pair of squeezing rollers 46 also rotatably disposed at the outlet side 43*b* of the developing tank 43. In a position above the squeezing rollers 46 of the developing device 42 and adjacent to a copy paper discharge opening O of the apparatus housing 2, there is disposed a fixing device 47 which includes a rotary heating roller 48, for example, having a heating element (not shown) incorporated therein, an endless pressing belt 50 movably supported by a plurality of rollers 49 for contacting part of the outer periphery of the heat roller 48 so as to transport the copy paper 1*a* therebetween and a copy paper separating claw 51 normally contacting the outer periphery of the heat roller 48 for separating the copy paper 1*a* after fixing.

In the copy paper feeding section 4 which is defined by the partition wall 2*a* at the left-hand portion of the apparatus housing 2, the roll 1 of copy paper 1*a* is mounted on a rotatable spool (not shown), while the leading edge portion of the copy paper 1*a* is drawn out from the roll 1 through two pairs of juxtaposed feeding rollers 52 and 53 between which cutter means 54 is disposed for cutting the copy paper 1*a* into a required size. In the direction of reciprocation of the scanning box 5 and along the passage of the copy paper sheet 1*a*, there are stretched guide wires 55*a* and 55*b*, for example, of gut or other suitable wire materials as transporting guide means for the copy paper 1*a*, while grounded guide plates 58*a* and 58*b* are disposed within the scanning box 5 in positions adjacent to opposite sides of the frame 17 for the transfer roller 16 in a direction parallel to the guide wires 55*a* and 55*b*. One end of each of the guide wires 55*a* is connected to a bracket 57 (FIG. 5) fixed to the scanning box 5 adjacent to the rear opening 5*a* thereof, with the other ends of the wires 55*a* being wound onto a winding roll 56*a* which is rotatably disposed adjacent to the feeding rollers 53 and having one end grounded, while one end of each of the guide wires 55*b* is connected to an edge of an opening 5*b* formed in the scanning box 5 in a position below the illuminating device 36, with the other ends of the wire 55*b* being wound onto a winding roll 56*b* which is also rotatably disposed adjacent to the inlet side 43*a* of the developing device 42 and having one end correspondingly grounded. The winding roll 56*a* is provided with spring means (not shown) for storing a counterclockwise urging force when the roll 56*a* is wound clockwise, while the roll 56*b* is also provided with spring means (not shown) which is adapted to store a clockwise urging force when the roll 56*b* is wound counterclockwise. Accordingly, the guide wires 55*a* and 55*b* are selectively wound onto and paid out from the corresponding rolls 56*a* and 56*b* respectively so as to be always kept horizontal.

Still referring to FIG. 1, at the right-hand upper portion of the apparatus housing 2 in a position below and adjacent to the platform 3, there is disposed the operating member 59 having microswitches MS3, MS4 and MS5 mounted thereon, the position of which operating member 59 is adjustable with respect to the direction of reciprocation of the scanning box 5, the microswitches MS3, MS4 and MS5 thus being adapted to be sequentially turned on by the contact thereof with an actuating member (not shown) fixed at one side of the scanning box 5 as said scanning box 5 advances. The same microswitches are electrically connected (not shown) in such a manner that the microswitch MS3 actuates the cutter means 54 to cut the copy paper 1*a* into the required size, and the microswitch MS4 turns off the corona charger 15, while the microswitch MS5 turns off the lamp 38 and simultaneously disengages the clutch (not shown) of the winding drum 7*a* for causing the scanning box 5 to run in the returning direction. It should be noted here that the transportation speed of the copy paper 1*a* is set to be the sum of the advancing speed of the scanning box 5 and the rotational circumferential speed of the photoreceptor drum 9.

The operation of the above described electrophotographic copying apparatus according to the present invention will be described hereinbelow.

Firstly, the operating member 59 and the guide rail 25 for the transfer roller 16 are set according to the size of the original to be copied. Prior to the copying operation, the scanning box 5 is located in the position shown by the chain lines in FIG. 1, while the leading edge of the copy paper 1*a* is in the scanning box 5 after being fed by the feeding rollers 52 and 53 and keeps the microswitch MS2 turned off. Accordingly, the upper feeding roller 29*b* is lowered to contact the lower roller 29*a* to hold the copy paper 1*a* therebetween, since the solenoid 34 is de-energized due to the microswitch MS2 being turned off as described above.

When a print switch (not shown) is turned on with the parts in the above state, the clutch for the winding drum 7*a* is engaged, with simultaneous energization of the illuminating lamp 38 and the corona charger 15, and the scanning box 5 starts running in the direction shown by the arrow A by the winding of the wire 8*a* onto the winding drum 7*a* as the drum 7*a* rotates clockwise. After initiation of the running of the scanning box 5, the rotary rollers 31 (FIG. 2) fixed at opposite ends of the shaft 30 of the lower feeding roller 29*a* ride over the guide rails 33, and consequently, the feeding roller 29*a* is raised together with the upper feeding roller 29*b*, with the copy paper 1*a* held therebetween, for transporting the copy paper 1*a* at a constant speed in the direction of the arrow A, in which case, the photoreceptor drum 9 is rotated counterclockwise through the gear 11 fixed to the shaft 10 of the drum 9, and the idle gear 12 engaging the gear 11 and also meshing with the rack 13. The photoreceptor surface 9*a* of the drum 9 thus rotated is given a predetermined value of charge by the corona charger 15 for subsequently being exposed to light images of the original P which is illuminated by the lamp 3, through the image transmitter 40 to form the latent image on said photoreceptor surface 9*a*.

During further advance of the scanning box 5 in the direction of the arrow A, the frame 17 for the transfer roller 16 is rotated clockwise (FIG. 3) about the shaft 18 as the roller 20 thereof rides onto the guide rail 25 and consequent raising of the stop 24 by the arm 21 which is pivoted clockwise about the pin 23, and thus the transfer roller 16 contacts the photoreceptor surface 9*a* under pressure. With the parts in this state, the leading edge of the copy paper 1*a* reaches the contact portion between the transfer roller 16 and the photoreceptor surface 9*a* in synchronization with the arrival of the latent image on the photoreceptor surface 9*a* thereat, with the copy paper 1*a* being pressed against the photoreceptor surface 9*a* by the transfer roller 16 so that the latent image is transferred onto the copy paper 1*a*, while the residual charge remaining on the photoreceptor surface 9*a* after the transfer is erased by the radiation of light rays from the lamp 38 through the light conducting portion 37*c* of the illuminating device 36. When the actuating member (not shown) fixed on the scanning box 5 actuates the microswitch MS3 to turn it on, during the above described transfer, the cutter means 54 is actuated to cut the copy paper 1*a* to the required size. Subsequently, when the actuating member (not shown) of the scanning box 5 turns the microswitch MS4 on, the corona charger 15 is de-energized, with the transfer being terminated, and the transfer roller 16 is spaced from the photoreceptor surface 9*a* through disengagement of the roller 20 from the guide rail 25 and consequent counterclockwise rotation of the frame 17 about the shaft 18. Upon subsequent actuation of the microswitch MS5 by the actuating member as the scanning box 5 further advances, the illuminating lamp 38 is de-energized, with disengagement of the clutch for the winding drum 7*a* for suspending the advancing of the scanning box 5, while the other winding drum 7*b* is rotated counterclockwise by the urging force stored in the spring means by the clockwise rotation thereof during advancement of the scanning box 5, and causes the scanning box 5 drawn by the wire 8*b* to run in the returning direction opposite to the advancing direction indicated by the arrow A.

Meanwhile, the copy paper 1*a* onto which the latent image is transferred in the above described manner is further introduced into the developing tank 43 of the developing device 42 through the opening 5*b* of the scanning box 5, with the leading edge of the copy paper 1*a* being held between the transportation rollers 45 disposed at the inlet side 43*a* of the tank 43, and is developed as it 1*a* passes between the developing roller pairs 44*a*, 44*b* and 44*c* immersed in the developing solution *d* in the tank 43, after which the copy paper 1*a* thus developed is fixed in the fixing device 47 as it passes through between the outer periphery of the heat roller 48 and the belt 50 of the same fixing device 47 and is subsequently discharged through the discharge opening O of the apparatus housing 2 onto a tray 60.

On the other hand, the scanning box 5 running in the returning direction stops upon reaching the standby position shown by the chain lines at the left in FIG. 1, and turns the microswitch MS1 on to energize the solenoid 34 the plunger 35 of which raises the upper feeding roller 29*b*, while the copy paper 1*a* is transported, through the copy paper feeding guide rollers 52 and 53, between the thus raised upper roller 29*b* and the lower feeding roller 29*a* which has preliminarily been lowered through disengagement of the rollers 31 thereof from the guide rails 33. When the microswitch MS2 is turned off by the leading edge of the copy paper 1*a* thus fed, the solenoid 34 is de-energized and the upper feeding roller 29*b* falls into contact with the copy paper 1*a* in preparation for the subsequent copying operation, and upon turning on of the print switch, the copying operations are repeated in a similar manner as described above.

Referring now to FIGS. 9 and 10, there is shown a modification of the guide portion for the transfer roller 16 of FIG. 3. In this modification, the frame 17 housing the roller 16 therein described as employed in the embodiment of FIG. 3 is replaced by a frame 17' including a pair of spaced side plates 17'*a* and 17'*b* which are fixed to each other at the upper portions thereof by rod members, for example, by a pair of rod members 17'*c* and 17'*d*, and rotatably supporting the transfer roller 16 between the side plates 17'*a* and 17'*b*, while a shaft 18' extends through the lower portions of the side plates 17'*a* and 17'*b* at positions below the rod member 17'*d* for pivotally supporting the frame 17' in a similar manner as in FIG. 3. At one end of the shaft 18' projecting out of the side plate 17'*a*, there is fixedly mounted an arm 21' having a roller 20' at the lower end thereof. On the other hand, the guide rail 25 of FIG. 3 is also replaced by a guide rail member 25' which is rotatably disposed in the direction of advance A of the scanning box 5 for positional adjustments. The guide rail member 25' has, for example, a guide portion 25'*a* for B5 size (182 × 257 mm), a guide portion 25'*b* for A4 size (210 × 297 mm) and a guide portion 25'*c* for B4 size (257 × 364 mm) mounted on the outer periphery of a shaft 25'*a* parallel to the axis thereof, and by manually turning the guide rail member 25', the guide portions 25'*a*, 25'*b* and 25'*c* are selectively brought into position for the corresponding copy sizes.

As is clear from the foregoing description, in the electrophotographic copying apparatus of the present invention, since the image forming elements such as the photoreceptor drum, optical system and the like are accommodated in the scanning box which is adapted to reciprocate within the apparatus housing for effecting slit exposure, transfer etc., not only can the the copying apparatus be made compact in size, but the means for moving the scanning box can be reinforced properly, because the scanning box is caused to run at the bottom portion of the apparatus housing in a stable manner. Furthermore, as compared with conventional copying apparatuses having movable platforms for the originals, the copying apparatus of the invention is free from influence due to difference in the weights of documents supported on the platform, thus being capable of achieving constant running speed of the scanning box, with consequent stable functioning of the copying apparatus.

Additionally, the arrangement in the copying apparatus of the invention wherein the image transmitter formed by a bundle of optical fibers having graded refractive indexes is employed for the optical system, with the single light source being commonly used both for illuminating the original and residual charge erasing is particularly effective for achieving miniaturization of the copying apparatus which has been in strong demand recently, and makes possible a simple control mechanism for the light source.

It should be noted here that, although the present invention is mainly described in the foregoing embodiment with reference to a copying apparatus wherein the latent image formed on the photoreceptor surface is directly transferred onto the copy paper sheet, the concept of the present invention is not limited to a copying apparatus of the above described type, but is readily applicable to an electrophotographic copying apparatus wherein the latent image formed on the photoreceptor surface is developed into a visible toner image for subsequent transfer onto the copy paper, by minor alterations of the image forming elements incorporated in the scanning box, for example, and by the addition thereto of a known dry type developing device of the magnetic brush or cascade type with simultaneous elimination of the wet type developing device 42.

Although the present invention has been fully described by way of example with reference to the attached drawings, it should be noted that various changes and modifications will be apparent to those skilled in the art. Therefore, unless otherwise such changes and modifications depart from the scope of the present invention, they should be construed as being included therein.

What is claimed is:

1. An electrophotographic copying apparatus of the slit exposure type which comprises;

a platform member of transparent material disposed at an upper face of said copying apparatus for holding an original to be copied on said platform member;

a scanning frame member which includes therein at least a photoreceptor of cylindrical configuration having the photoreceptor surface on the outer periphery thereof, corona charging means for preliminarily charging the photoreceptor surface, an optical system for projecting a light image of the original onto the preliminarily charged photoreceptor surface for forming an image corresponding to the original on the photoreceptor surface, and means for transferring said image corresponding to the original onto a transfer material, said scanning frame member being movably disposed in said copying apparatus for reciprocation at a predetermined speed in a direction parallel to said platform member for scanning the original for forming said image corresponding to the original on said photoreceptor surface;

means for moving said scanning frame member from a scanning starting position in one direction for advancing the scanning frame member at the predetermined speed in a direction parallel to said transparent platform and from a scanning terminating position in the other direction for returning the scanning frame member to the starting position after termination of the scanning;

means for rotating said photoreceptor in association with the movement of said scanning frame member;

means for transporting the transfer material between said photoreceptor and said transfer means in the direction of the advancing of said scanning frame member at a speed equivalent to the sum of the speed of the advancing of said scanning frame member and the circumferential speed of rotation of said photoreceptor; and means for guiding the transfer material between the scanning starting position and the scanning terminating position of said scanning frame member;

whereby said transfer material is transported for transfer of said image formed on said photoreceptor thereonto as it is transported at said speed which is the sum of the speed of advancing of said scanning frame member and the circumferential speed of rotation of said photoreceptor.

2. An electrophotographic copying apparatus as claimed in claim 1, wherein said optical system includes an image transmitter formed by a bundle of optical fibers having graded refractive indexes.

3. An electrophotographic copying apparatus as claimed in claim 1, wherein said optical system includes an illuminating means for the original and means for directing light rays from said illuminating means to the original and onto said photoreceptor surface at a position following said transfer means for erasing residual charges remaining on said photoreceptor surface.

4. An electrophotographic copying apparatus as claimed in claim 1, wherein said transfer means is a transfer roller member for transferring an electrostatic latent image corresponding to the original and formed on said photoreceptor surface onto the transfer material as it is transported by said transporting means between said photoreceptor and said transfer roller.

5. An electrophotographic copying apparatus as claimed in claim 1, further including means for causing the transfer means to selectively contact said photoreceptor with the transfer material therebetween.

6. An electrophotographic copying apparatus as claimed in claim 1, wherein said moving means for said scanning frame member includes at least a wire member for causing said scanning frame member to advance.

7. An electrophotographic copying apparatus as claimed in claim 1, wherein said rotating means for said photoreceptor includes a shaft on said photoreceptor, a gear on said shaft, a rack member disposed at one side of said scanning frame member and extending in a direction parallel to the scanning direction, and a pinion gear engaged with said gear and said rack member for rotating said photoreceptor in the same direction as the scanning direction at the point of contact between said photoreceptor and said transferring means.

8. An electrophotographic copying apparatus of the slit exposure type which comprises;

a transparent platform fixedly disposed at an upper face of said copying apparatus for holding an original to be copied on said transparent platform;

a base portion at a lower portion of said apparatus;

a scanning box movably disposed on said base portion for reciprocation at a predetermined speed in a direction parallel to said transparent platform, said scanning box further including therein a rotary photoreceptor drum having a photoreceptor surface on the outer periphery thereof, an optical system having an image transmitter formed by a bundle of optical fibers having graded refractive indexes for projecting a light image of the original onto the photoreceptor surface for forming thereon an image corresponding to the original, a corona charging device disposed adjacent to said photoreceptor surface in a position prior to a portion of said photoreceptor surface on which said image corresponding to the original is formed, and a transfer roller for transferring said image corresponding to the original onto a transfer material, said transfer roller being movable between a first position in which it contacts said photoreceptor surface only through the transfer material and a second position in which it is spaced from said photoreceptor surface;

means for moving said scanning box in an advancing direction from a starting position for scanning at the predetermined speed in a direction parallel to said transparent platform and in a returning direction to said starting position after termination of said scanning and including at least a wire member;

means for rotating said photoreceptor drum in association with the movement of said scanning box;

means for transporting the transfer material between said photoreceptor and said transfer roller in the direction of the advancing of said scanning box at a speed equivalent to the sum of the speed of the advancing of said scanning box and the circumferential speed of rotation of said photoreceptor, and including a pair of rollers disposed in said scanning box in a position adjacent the transfer position; and means for guiding the transfer material between the scanning starting position and scanning terminating position of said scanning box.

9. An electrophotographic copying apparatus as claimed in claim 8, wherein said moving means for said scanning box includes an advancing wire member fixed to a front portion of said scanning box, an advancing winding roller for winding said advancing wire member thereonto to cause said scanning box to advance from the starting position for the scanning, a returning wire member fixed to a rear portion of said scanning box, a returning winding roller for winding said returning wire member thereonto to cause said scanning box to return to said starting position after the termination of said scanning, said returning winding roller being provided with spring means to store a return force during the advancing of said scanning box to return said scanning box toward said starting position through rotation of said returning winding roller upon the termination of said scanning.

10. An electrophotographic copying apparatus as claimed in claim 8, wherein said rotating means for said photoreceptor drum includes a shaft on said photoreceptor drum, a gear fixed to said shaft, a rack member disposed at the side of said scanning box and extending in a direction parallel to the scanning direction, and a pinion gear engaged with said gear and rack member for rotating said photoreceptor drum in the same direction as the scanning direction at the point of contact between said photoreceptor drum and said transfer roller.

11. An electrophotographic copying apparatus as claimed in claim 8, further comprising a transfer frame member pivotally connected to a lower portion of said scanning box, in which said transfer roller is accommodated, said transfer frame member being movable about the pivotal connection between a first position for transfer at which said transfer roller contacts said photoreceptor surface through the transfer material and a second position at which said transfer roller is spaced from said photoreceptor surface, said transfer frame member having a raising member at a lower portion of said frame member, and a guide rail member having a trapezoidal configuration disposed at a lower portion of said copying apparatus and engaged by said raising member during scanning movement for moving said transfer frame member from said second position to said first position.

12. An electrophotographic copying apparatus as claimed in claim 8, wherein said optical system includes an illuminating means for the original and means for directing light rays from said illuminating means to the original and onto said photoreceptor surface at a position following said transfer means for erasing residual charges remaining on said photoreceptor surface.

* * * * *

UNITED STATES PATENT AND TRADEMARK OFFICE

CERTIFICATE OF CORRECTION

PATENT NO. : 4,116,557

DATED : September 26, 1978

INVENTOR(S) : TEIZO KUSHIMA, TAKAJI KURITA and HIROAKI MIZUNOE

It is certified that error appears in the above-identified patent and that said Letters Patent are hereby corrected as shown below:

Item 30 for Japanese Application Number 51/156506
substitute 50-156506

Signed and Sealed this

*Twenty-seventh* Day of *February 1979*

[SEAL]

*Attest:*

RUTH C. MASON
*Attesting Officer*

DONALD W. BANNER
*Commissioner of Patents and Trademarks*